US009056451B2

(12) United States Patent
Rogge et al.

(10) Patent No.: US 9,056,451 B2
(45) Date of Patent: Jun. 16, 2015

(54) SYSTEM FOR GRIPPING A CYLINDER CONDUCTING INK IN A PRINTING PRESS

(75) Inventors: Guenter Rogge, Lienen (DE); Georg Rasch, Muenster (DE); Marco Finke, Muenster (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 1240 days.

(21) Appl. No.: 12/736,949

(22) PCT Filed: May 27, 2009

(86) PCT No.: PCT/EP2009/003743

§ 371 (c)(1),
(2), (4) Date: Nov. 24, 2010

(87) PCT Pub. No.: WO2009/146819

PCT Pub. Date: Dec. 10, 2009

(65) Prior Publication Data

US 2011/0072992 A1 Mar. 31, 2011

(30) Foreign Application Priority Data

May 29, 2008 (DE) ..... 10 2008 025 995

(51) Int. Cl.
*B41F 13/34* (2006.01)
*B41F 13/00* (2006.01)

(52) U.S. Cl.
CPC ..... *B41F 13/34* (2013.01); *B41F 13/0016* (2013.01); *B41P 2213/804* (2013.01)

(58) Field of Classification Search
CPC ..... B41F 9/18; B41F 13/34; B41F 13/40; B41F 13/38; B41F 13/36; B41F 31/30; B41F 13/0016; B41P 2213/804; B41P 2213/80; B41P 2213/802; B65H 2405/42; B65H 2405/423; B65H 2405/40; B65H 2405/422
USPC ..... 101/479, 480, 216, 181, 183
See application file for complete search history.

(56) References Cited

U.S. PATENT DOCUMENTS

| | | | | |
|---|---|---|---|---|
| 1,591,452 | A * | 7/1926 | White | 101/352.01 |
| 4,572,069 | A * | 2/1986 | Schwarzbeck | 101/76 |
| 4,586,434 | A * | 5/1986 | Tokuno et al. | 101/178 |
| 5,010,813 | A * | 4/1991 | Buffo | 101/178 |
| 5,142,978 | A | 9/1992 | Borel | |
| 5,282,418 | A * | 2/1994 | Uera | 101/216 |
| 5,588,361 | A * | 12/1996 | Riis | 101/216 |
| 6,038,972 | A * | 3/2000 | Delwiche et al. | 101/216 |
| 6,283,024 | B1 | 9/2001 | George | |
| 2011/0120330 | A1 * | 5/2011 | Rogge | 101/329 |

FOREIGN PATENT DOCUMENTS

| | | |
|---|---|---|
| DE | 82 33 414 U1 | 3/1984 |
| DE | 84 06 471 U1 | 5/1986 |
| DE | 42 04 472 C2 | 9/1992 |
| DE | 691 02 010 T2 | 9/1994 |

(Continued)

*Primary Examiner* — Matthew G Marini
*Assistant Examiner* — Leo T Hinze
(74) *Attorney, Agent, or Firm* — Jacobson Holman, PLLC.

(57) ABSTRACT

A device for gripping and transporting at least one ink-attracting cylinder of a printing machine includes support elements that can enter into contact with pins of the cylinder in order to be able to raise the cylinder, Each support element includes at least two tong-like gripper arms with which a pin of the cylinder can be at least partially gripped.

21 Claims, 4 Drawing Sheets

(56) References Cited

FOREIGN PATENT DOCUMENTS

| | | | |
|---|---|---|---|
| DE | 198 18 389 | A1 | 11/1999 |
| DE | 102 09 536 | A1 | 5/2003 |
| EP | 0 169 475 | B1 | 1/1986 |
| EP | 1 016 522 | A1 | 7/2000 |
| GB | 2 158 774 | A | 11/1985 |
| WO | WO 94/18007 | | 8/1994 |
| WO | WO 2008/025804 | A2 | 3/2008 |

* cited by examiner

II-II

III-III

VII - VII

VI - VI

XI - XI

X - X

SYSTEM FOR GRIPPING A CYLINDER CONDUCTING INK IN A PRINTING PRESS

CROSS-REFERENCE TO RELATED APPLICATIONS

This is a national stage of PCT/EP09/003743 filed May 27, 2009 and published in German, which has a priority of German no. 10 2008 025 995.0 filed May 29, 2008, hereby incorporated by reference.

BACKGROUND OF THE INVENTION

1. Field of Invention

The invention concerns a device for gripping and transporting at least one ink-attracting cylinder of a printing machine in which the device includes support elements that enter into contact with pins of the cylinder in order to be able to raise the cylinder, in which each support element includes at least two gripper arms, with which a pin of the cylinder can at least be partially gripped, a first gripper arm being movable between an open position and a closed position in which the pin is gripped, and a second gripper arm being fixed. The invention also relates to an ink-attracting cylinder and a method for gripping and transporting at least one cylinder.

2.Description of the Prior Art

It is often necessary to change the rolls of a printing machine for completion of print jobs. Most often the actual printing cylinders are generally changed, since they carry the medium that ensures the print pattern on the stock. Such printing cylinders generally include a cylinder body and a pin on each of its ends. The surface of the cylinder body is available for the medium, which is glued, for example, to the cylinder body or fastened on a sleeve, which is then pushed onto the cylinder body, while the pins are provided especially for supporting of the cylinder in the printing machine. If such a cylinder is to be changed, it is also gripped via the pins.

The present invention, however, does not pertain merely to printing cylinders, but to all cylinders in a printing machine that attract ink. In particular, these can be anilox rollers. For example, anilox rollers in a flexographic printing machine serve to apply printing ink to the printing cylinders. Anilox rollers can also be replaced, for example, when the printing ink is changed in the corresponding inking system.

In a central cylinder flexographic printing machine the inking systems are generally arranged around a central impression cylinder. Each inking system then includes at least one printing cylinder, which can be set against the impression cylinder carrying the stock. The anilox roller can again be set against the printing cylinder, which removes the printing ink that it transfers to the printing cylinder from an ink reservoir, for example, a doctor blade chamber. Machines are also known in which an ink coating roller is connected between the ink reservoir and the anilox roller.

Printing machines that operate according to other printing methods include additional and/or other cylinders than those described for flexographic printing.

In order to be able to set the different rollers and cylinders against each other, each of them is mounted with its pins in a bearing element that can be moved relative to the printing machine frame. In the example of flexographic printing this bearing element is often a bearing block that can be moved on guides. These guides and the bearing block are arranged on or against brackets of the printing machine frame.

In order to be able to change the cylinders a system for gripping and transporting at least one ink-attracting cylinder is provided in printing machines of the prior art, which can take up the pins that pass through the elements from the ends. Support elements are configured for this purpose so that the pins lie on them. The support elements are then arranged on a movement device which in turn is arranged on a support frame and can be moved relative to it. The movement device is configured so that the support elements can be moved past the bracket of the printing machine frame on the outside in order to be able to grip the pins from the outside. Publication EP 1 016 522 A1 shows such a system. Cylinders with pins on the end are also often referred to as print rolls.

Gripping of the pins from the end, however, means that a large space on both sides of the printing machine is required for the gripping and transport system.

The task of the invention is therefore to propose an improved system that gets by with a smaller space.

SUMMARY OF THE INVENTION

The task is solved by the features of the invention described herein. It is therefore proposed that each support element include at least two gripping jaws designed tong-like with which a pin of the cylinder can be at least partially enclosed.

With this invention it is therefore possible for the rolls not to be gripped from the side (viewed in the axial direction), but from the top. The support elements can then be introduced between two brackets and can then grip the cylinder pins. Generally two such support elements are provided, by each of which a pin of the roller is gripped. Based on the tong-like design the movement to grip the pin need only occur in the radial direction. This arrangement has advantages not only with respect to space consumption, but also offers the freedom to design the entire inking system according to desire. It can now be prescribed to allow different devices to act on the ends of the pins facing away from the cylinder body. In particular, a drive can be provided whose drive shaft is essentially flush with the axis of rotation of the cylinder. Such drives are known as “direct drives”.

According to an advantageous variant of the invention it is proposed that a first gripping jaw be fixed. This gripping jaw can be mounted fixed on a movement device of the system. This movement device can be a boom of a crane. A second gripping jaw is then equipped movable so that the pin can be gripped by movement of the second gripping jaw. Because of this arrangement the mechanical expense for movement of the gripping jaws is kept as low as possible. The movement device in this case can bring the first gripping jaw to the pin of the cylinder so that it lies against the pin or almost lies against it. The second gripping jaw can then be moved so that the pin is now gripped and securely held. Falling down of the cylinder is therefore almost ruled out.

It is particularly advantageous that the second gripping jaw can be moved between an opened position and a closed position in which the pin is gripped and if the second gripping jaw can be locked in the closed position by a locking device. This locking device therefore prevents the second gripping jaw from inadvertently opening and falling of the cylinder from the support elements. Only when the locking device is unlocked is opening of the second gripping jaw possible.

In an advantageous embodiment it is proposed that the second gripping jaw be arranged on the end of a shaft. The gripping jaw extends radially from the shaft. The shaft can then be acted upon with a torque so that rotation of the shaft leads to pivoting of the gripping jaw. This design is advantageous, since the pin is not supposed to be gripped in the area of the end, but parts of the movement device, especially the boom can be situated farther outward.

It is also advantageous if the second gripping jaw is movable by means of a slide, which can act on the mentioned shaft, the slide being drivable by a pressure cylinder. Since the gripping jaws need only be moved into two different positions (opened and closed position) the use of a pressure cylinder is a cost-effective possibility for a drive, especially when the pressure cylinder is a compressed air cylinder. The force that acts on the drive is conveyed according to the invention through the slide of the shaft and/or the second gripping jaw.

In an advantageous variant of the invention it is proposed that the shaft include a pin extending radially away from it, which engages in a link introduced to the slide. If the slide is moved in the axial direction and varies the distance of the link from the movement direction, the pin is moved laterally and causes rotational movement of the shaft and therefore a pivoting movement of the gripping jaws, since the shaft is mounted unmovable axially. In this way an inexpensive, space-saving and mechanically simple possibility is created for imparting rotational movement to the gripping jaws. A further advantage will become obvious by the feature described in the next paragraph.

It is therefore advantageous if the slide carries the locking device on one end, which includes a pin. In the locking position, i.e., when the gripping jaw is in the closed position, this pin engages in a hole of the gripping jaw running parallel to the shaft. Unintended pivoting of the gripping jaw is prevented simply with this pin. In particular, the locking device does not require its own drive device for activation. Instead the drive that moves the slide is sufficient, since it includes the locking device.

A further aspect of the invention concerns the position of the two gripping jaws relative to each other when they are in the closed position. The gripping jaws have support edges on which the pin lies when it is supported. It is advantageous if the support edges have an angle of less than 180°. The support edges then lie on the lines of an open triangle that serves as a receiving recess for the pin so that it does not slide laterally or even roll.

It is then preferred if this angle is 120° or less. 120° is the angle the two edges of a regular hexagon enclose relative to each other. However, it is particularly preferred if the two support edges assume an angle of 60° which two lines in an equilateral triangle assume. If the cylinders also have corresponding truncations, which can be circumscribed by an equilateral triangle, it is advantageous that the support edges are configured so that they lie fully against the surfaces.

In another advantageous variant it is proposed that the support element includes a contact element that lies against the pin when the gripping jaws enclose the pin or at least when the movement device has already moved the gripping jaws into a position in which the gripping jaws can be closed. Likewise the contact element can already be in contact with the pin when the movement device is still or already moving the gripping jaws.

It is then advantageous if the contact element can be acted upon with a force that can be applied from a biased spring element. If the gripping jaws are moved to the pin by the movement device, the contact element is moved against this force. When the gripping jaws are closed, the contact element (because of said force) forces the pin against the support edges of the gripping jaws. It is particularly advantageous if the contact element has a contact surface that lies against one or more truncations of the pin so that the force effect on the pin occurs over the largest possible contact surface. It is worth mentioning in this context that the contact surface and the support edges form a equilateral triangle. If the pin also includes truncations that are inscribed in the same equilateral triangle, the pin is completely fixed during transport. Even during a collision of the cylinder during transport it is very unlikely that the cylinder is released from the "grip" of the support element.

In order to guarantee perfect function of the contact element free of disturbance this can be movable along guides relative to the support element.

In another advantageous embodiment it is proposed that the support element include sensors with which the positions of the contact element can be determined. In this way it can be established how far the contact element was pushed by advance of the support element. Assertions can then be made whether an unintended collision is present. This information can then be used by a control device of the system according to the invention for an appropriate reaction, which can be an emergency stop. These sensors are also particularly advantageous if different cylinder types in the printing machine have different diameters, at least in the areas in which the contact element engages. In this case assertions can be made about the cylinder types via the position determinations. In this way errors during equipping of the printing machine can be recognized, is, for example, an anilox roller was incorrectly gripped instead of a printing cylinder. Such error recognition permits immediately problem handling, which ultimately means that the printing machine can be set up quickly.

The invention also concerns ink-attracting cylinders in a printing machine, which include a cylinder body and pins on the end. Each pin according to the invention includes at least three truncations on an axial position. Because of these truncations it is possible to reliably grip such pins with the gripping jaws of a system for gripping and transport. In addition to secure holding, it is also possible to transport the cylinder in a defined angle position.

In another advantageous variant of the cylinder it is proposed that each pin include at least an additional truncation on an additional axial position. It is therefore possible to place the cylinder with this truncation in a cylinder bearing on a support surface. The cylinder then occupies a defined angle position in the cylinder bearing, the so-called "null position". In conjunction with the truncations mentioned in the previous section the cylinder can now be gripped without changing its angle position either during gripping or during transport. The cylinder can therefore be inserted into the inking system in a defined angle position. If the medium of a printing cylinder is additionally aligned in this null position, the control of the printing machine can pre-position this printing cylinder in the peripheral direction with reference to the other printing cylinders. This expedient overall leads to a shortened startup time during printing of a print job. Printing cylinders advantageously have an additional truncation, anilox rollers can have three additional truncation, if the number of first truncations also lies at three and so forth. In an anilox roller no attention need be paid to positioning of the print pattern, for which reason the angle position plays no role.

Further practical examples of the invention follow from the description and claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given. by way of illustration only, since various changes and modifications within the spirit and scope of the invention will become apparent to those skilled in the art from this detailed description.

Figure 1:
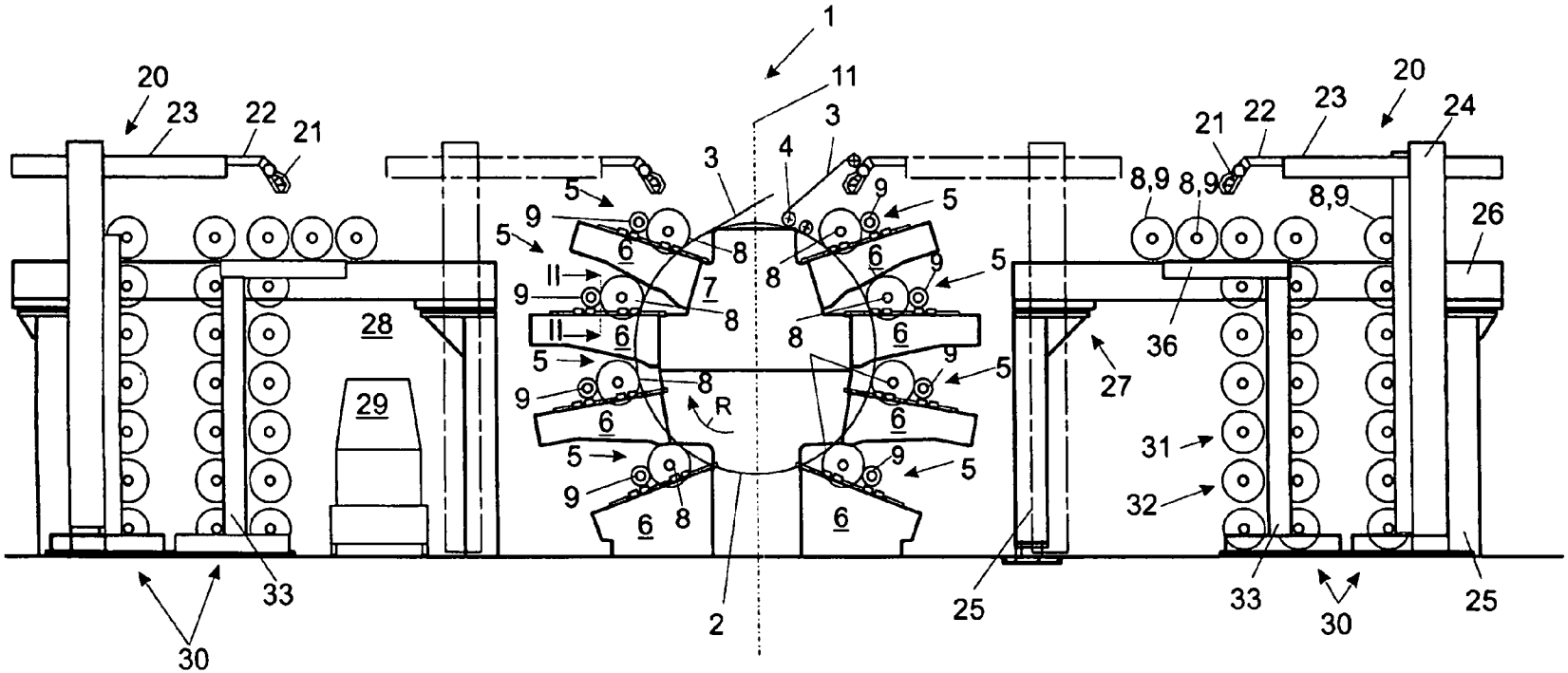
FIG. 1 Side view of a printing machine

FIG. 1 shows a printing machine, which in the depicted practical example represents a central cylinder flexographic printing machine. It therefore includes a impression cylinder 2 on which the stock 3 is guided. The direction of rotation of the impression cylinder is shown by arrow R. In order for the stock 3 to lie fully on the impression cylinder 2 before the first printing roller, it is guided by a pressure roller 4.

Several inking systems 5 (8 in the depicted practical example) are arranged around the impression cylinder 2. Each inking system 5 initially includes a bracket 6 which extends away from a central machine frame 7. Each bracket carries the cylinders that are necessary for printing of one color. The printing rollers 8 are adjustable on the impression cylinder 2. For application of printing ink to the printing rollers 8 anilox rollers 9 are provided, which can be set accordingly against the printing rollers 8. The anilox rollers 9 are supplied with the desired printing ink from the doctor blade chambers 10 not shown in FIG. 1. Since the printing rollers 8, optionally also the anilox rollers 9 are to be replaced with ones with different diameters or ones with differences with reference to other properties (for example, feed volume in anilox rollers), the mentioned rollers 8, 9 are mounted in bearing blocks which can be moved relative to the impression cylinders by means of appropriate movement devices. These movement devices can include guide rails, which are fastened on or against the brackets and extend away from the impression cylinder. The movement devices also includes drives to move the bearing blocks along the guide rails, in which these drives generally have a spindle-spindle nut combination.

Each of the mentioned rollers 8, 9 is supplied with a drive torque by torque-feeding components. These are often gears that mesh with the gear mounted on the roller. These gears can be driven by a central drive. However, printing machines have also been known for years, which include a drive for each roller 8, 9, which drive the corresponding roller via gears.

For replacement of rollers the bearings of the bearing blocks that support these rollers are equipped so that removal of rollers is possible. It is advantageous if the bearings remain on the pins of the rollers and the part of the bearing block are tilted back so that the rollers can be removed upward. The roller is also to be disconnected (optionally beforehand) from the drive train.

For further explanation of a roller change the printing machine is divided into two halves by an imaginary center line 11 so that half of the inking systems 5 lies on each side of the center line. Each half is served by a crane 20 in the depicted practical example. The crane 20 is capable of removing both the printing rollers 8 and the anilox rollers 9 or all rollers involved in the printing process from the printing machine or supplying them to it. The crane 20 includes grippers 21 for gripping of rollers 8, 9, which are capable of gripping the pins of the roller. One gripper 21 is therefore allocated to each end of the roller.

Each gripper 21 is arranged on one end of a boom 22, the boom being movable along a support beam 23. The booms and support beams are advantageously arranged horizontally. With this arrangement it is possible to introduce the grippers 21 between two brackets 6 into the printing machine and to grip a roller 8 or 9 there. In order to reach the different inking systems arranged one above the other, the support beam 23 is arranged movable in height on a vertical support 24. In order to further expand the movement capabilities the vertical support 24 is also movable. The vertical support 24 for this purpose is arranged in or on a support frame 27. The support frame 27 then consists of two columns 25 which are connected to each other by a support 26. The vertical support 24 then advantageously runs on rails arranged against or on support 26. To summarize, it can be stated that the crane overall has three movement possibilities, two of which preferably move the gripper 21 in the horizontal direction and one in the vertical direction. In this way it is possible to operate all inking systems with rollers and leave the actual support frame 27 completely outside of the printing machine. It should be emphasized here that the movement directions of the crane always lie parallel to a plane perpendicular to the axes of the rollers. In other words the crane is not capable of moving the rollers in the axial direction. For each of the three mentioned movement possibilities a separate drive, for example, electric motor, is provided.

The rollers 8, 9, which are to be raised from the inking systems by means of crane 20 can be placed in the roller bearings 30. The roller bearing 30 includes numerous roller positions 31 in each of which a roller 8, 9 can be placed. The crane 20 with its possible movement paths can transport a roller 8, 9 not only between an inking system and a roller position 31, but also between two roller positions 31 so that during printing operation the rollers can be arranged in roller bearings so that setup for the next print job can occur as effectively as possible, i.e., with the shortest possible movement paths for crane 20.

In order to be able to supply the printing machine 1 according to the invention with printing or in transfer rollers as required, a free space 28 is provided between the actual printing machine and the lower bearings 30, into which a roller transport cart 29 can be introduced and positioned. The crane 20 can naturally grip the rollers supplied in this way and place them in the roller bearing 30 and/or into the inking systems. The rolls to be transported away can then be raised onto the roller transport cart 29.

At least one of the roller positions 31 is designed as a change position 32 in which a roller 8, 9 can be held on one end by devices described further below so that a printing or anilox roller sleeve pushed onto the roller can be pulled off axially over the unsecured end. Overall, anilox rollers or printing rollers can be mounted in any roller positions 31.

The roller positions 31 are arranged on columns 33 of roller bearing 30. To accommodate the rollers in the roller positions 31 vertically spaced overhangs 34 are applied to the columns 33, which enclose recesses 35 on the outside, which accommodate the pins of the rollers in order to prevent rolling away (see FIG. 2).

On certain columns 33 essentially horizontal supports 36 are arranged, which enclose additional roller positions. These horizontal supports 36 at least partially span the free space 28 into which a roller transport cart 29 can be introduced. This expedient also contributes to keeping the times for equipping the inking systems 5 with new rollers as short as possible.

For each half of the printing machine 1 a roller bearing 30 with at least 18 roller positions 31 is provided. These 18 rollers positions are suitable for accommodating three sets of printing rollers with four rollers each and one set of anilox rollers with four rollers. Two additional positions are equipped as change positions and/or serve to accommodate one or more rollers that have been removed from an inking system. If both free positions to accommodate two rollers from one or more inking systems and change positions to be kept open are provided, the number of prescribed roller positions is increased to at least 20. If the printing machine is exclusively operated with rollers with pushed-on printing sleeves, no rollers need be supplied with the roller transport car 29. For each inking system four printing rollers are then available, which covers almost the entire format length range essentially available to the printing machine in conjunction with printing sleeves with different outside diameters without requiring the so-called adapter sleeves, for example.

Figure 2:
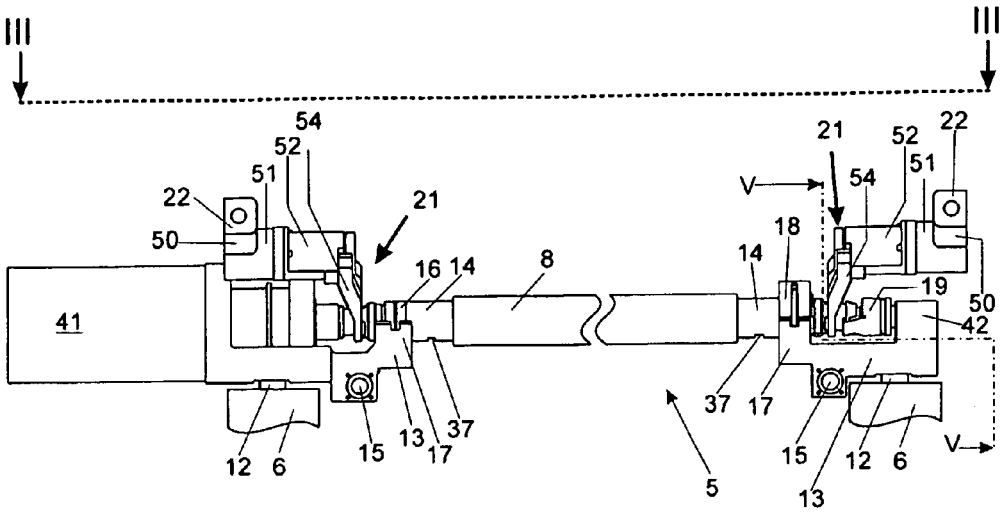
FIG. 2 View II-II from FIG. 1

FIG. 2 shows the view II-II from FIG. 1 in which the crane with its grippers 21 has already gripped the printing roller 8 or has still not released it. In this view different components of the inking system 5 can be seen, which are not marked in FIG. 1. On each of the two brackets 6 guide rails 12 on which the bearing blocks 13 in which the printing roller 8 with its pins 14 is mounted at least in printing operation, is movable. Driven spindle-spindle nut combinations work for movement, the spindle nuts 15 of which, which are arranged fixed in the bearing blocks, are apparent. However, other types of drive to move the bearing blocks can be used instead.

Bearings 16, which lie in corresponding shells 17, which are components of the bearing blocks 13, are arranged on the pins 14. The left of the two shells 17 is shown in the open state, whereas the right bearing is shown still closed. A cover 18 is tilted over the bearing 16 and connected to shell 17 so that the roller 8 during printing operation cannot move relative to the bearing block. The printing roller 8 can be connected to an attachment 40 or drive 41 via couplings 19, whose method of function will not be further described here. The drive advantageously acts gearless on printing roller 8. The attachment 40, which can be moved by a movement device 42 not further shown in the axial direction of roller 8 has already been removed from the pin 14 of printing roller 8 in FIG. 2. The drive 41 in the depicted view, however, is still coupled to rotate in unison with the printing roller 8. It is worth mentioning that the part of the coupling 19 mounted on the frame is acted upon with torque from the drive 41 by means of a shaft bellows, which can be compressed and stretched in the axial direction and has torsional rigidity in the peripheral direction.

It is shown in this figure that each gripper 21 of crane 20 has already gripped a pin 14. An angle piece 50 is firmly applied to each boom 22 of the crane 20 on the end. Each angle piece 50 carries a support piece, which is formed in the depicted practical example as a tube-like piece 51 whose axis runs perpendicular to the direction of extent of boom 22 and therefore parallel to the axial extent to printing roller 8. The support piece mostly carries the actual gripper 21 and other components still to be described. A bearing and guide piece 52 are arranged on the support piece. The bearing and guide piece represents an inside extension of the support piece. On the inside, i.e., facing the printing roller 8, the gripping jaws 53 and 54 of the gripper 21 are arranged on the bearing and guide piece 52.

Different configurations from variants of the boom, angle pieces, support pieces and bearing and guide pieces are conceivable. Different combinations of these components can be designed in one piece or individual components can be dispensed with out departing from the inventive idea. However, it is especially advantageous that support pieces and bearing and guide pieces extend to the roller viewed in the axial direction from the angle piece. In this case the boom and angle piece are moved on the outside past the ends of the pins of the rollers, while the gripping arms grips the pins farther inward.

Figure 3:
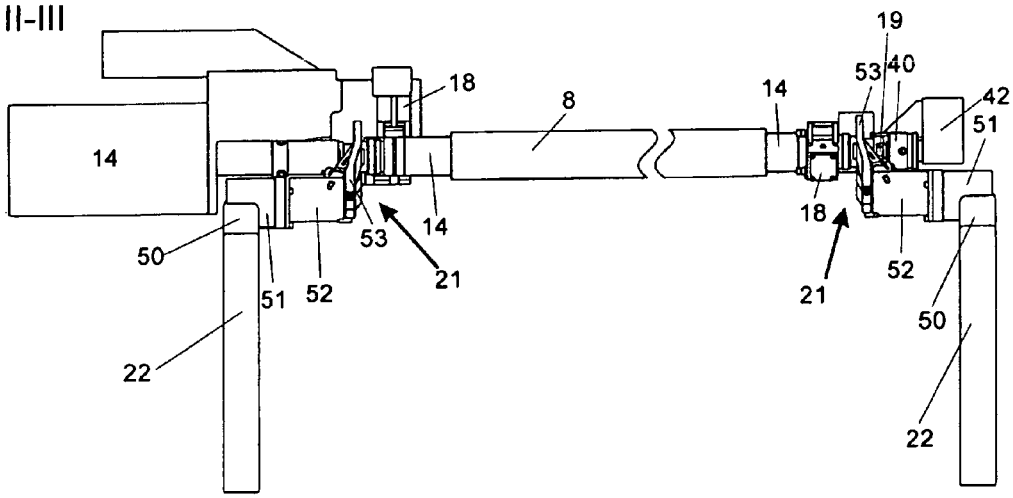
FIG. 3 View III-III from FIG. 2

FIG. 3 shows view in FIG. 2. The same components are provided with the same reference numbers so that repeated description of these components is dispensed with. It is again apparent from this figure that the components 51 and 52 extend from the boom in the direction of printing rollers 8. A first gripper arm 53 is arranged on the inside on bearing and guide piece 52. This first gripper arm 53 is advantageously mounted to rotate in a bearing and guide piece 52. A second gripper arm 54, preferably fixed, is also raised on the inside on the bearing and guide piece (see FIG. 2).

Figure 4:
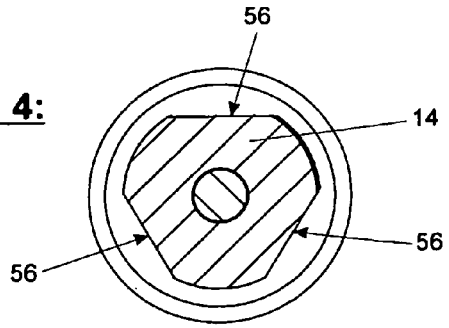
FIG. 4 Section through the pin of an ink-transferring roller according to the invention FIG. 5 View V-V from FIG. 2

FIG. 4 shows view IV-IV from FIG. 2. This view represents a cross section through the pin 14 on the axial position at which the two gripper arms 53 and 54 grip the pin. The gripper arms 53, 54 have contact surfaces on the areas with which they come in contact with the pin, which can carry a replaceable wear layer 55 (see FIG. 5). In order to be able to firmly grip the roller, it has truncations 56 on the peripheral surface on the mentioned axial positions, which are fully in contact with the replaceable wear layer 55 preferably in the peripheral direction. The truncations are preferably uniformly distributed on the periphery of the pin so that they lie in the depicted practical example on the edge of a uniform triangle. Two truncations consequently enclose an angle of 60° relative to each other. The contact surfaces of the gripper arms 53 and 54 also enclose an angle of 60° relative to each other.

Figure 5:
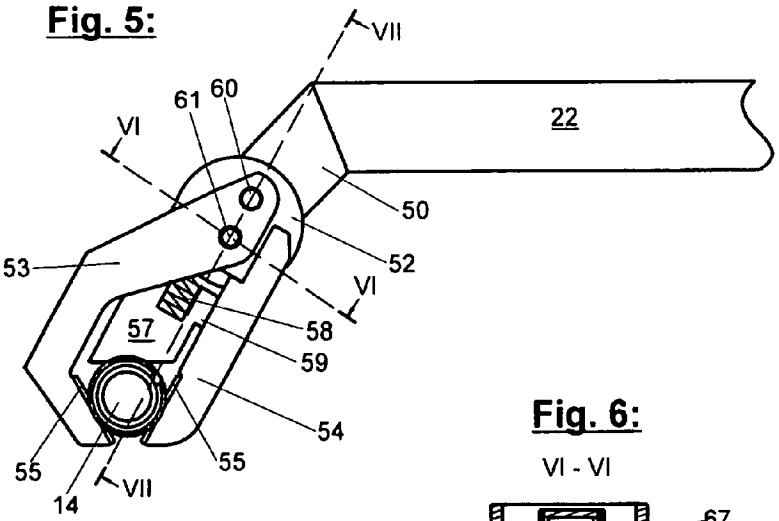

FIG. 5 shows view V-V from FIG. 2. It is shown in FIG. 5 that the first gripper arm 53 and the second gripper arm 54 have gripped the pin 14 and roller 8. In addition, a contact element 57 lies against the pin 14. This contact element 57 is mounted movable relative to the bearing and guide piece. In addition, a spring element 58 act on this contact element 57, whose force acts in the direction for pin 14 so that the contact element presses on the pin. Since the contact element 57 lies against one of the truncations 56 with a straight edge, the pin is secured from rotation. In addition, the contact element 57 presses the pin 14 against gripper arms 53, 54 so that the pin is secured against falling out. The gripper arm 54 has a guide groove (not shown) in which the attachment 59 and the contact element 57 engages. The second guide can also be provided, which consists of a pin applied to the contact element, which engages in a hole in the bearing and guide piece 52. As an alternative the pin can be fastened in the bearing and guide piece 52 and engage in a hole of the contact element 57.

The shaft 60 is also apparent in FIG. 5, on which the first gripper arm 53 is firmly arranged. The gripper arm is pivotable around shaft 60 when acted upon with a torque. The first gripper arm 53 additionally includes a hole 61 in which a locking pin can engage. As soon as this has occurred, the gripper arm 53 is secured against pivoting so that unintended opening of the gripper 21 is avoided. The gripper arm 54 is firmly mounted on the bearing and guide piece 52.

Figure 7:
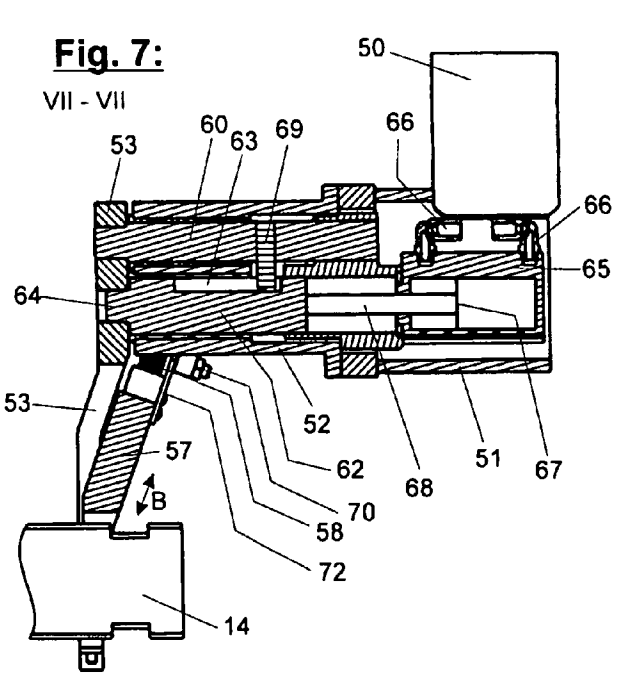
Figure 6:
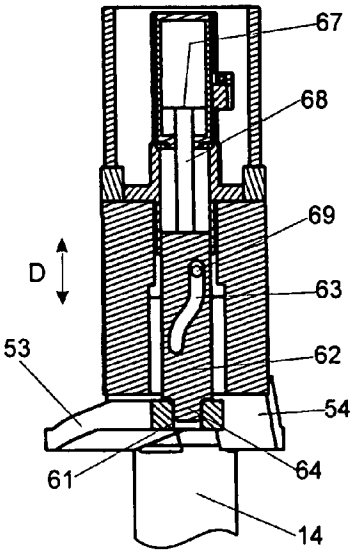
FIG. 6 The components of the mechanism with which the first gripping arm is pivoted FIG. 7 The components from FIG. 6 and a sensor FIG. 8 The side view of the sheet from FIG. 7

FIGS. 6 and 7 show the components of the mechanism with which the first. gripper arm 53 is pivoted. For this purpose a slide 62 is arranged movable in the bearing and guide piece 52 in the direction of the double arrow D. A guide groove 63 is made in this slide, whose ends are offset laterally, i.e., across the direction of double arrow D. A pin 69 is fastened to the shaft 60 and engages in the guide groove 63. Movement of the slide 62 now causes forces to act laterally on pin 69, which exerts a torque on shaft 60 so that the first gripper arm 53 is pivoted. The slide 62 has a locking pin 64 on its end facing the first gripper arm 53, which can engage in the hole 61 of the first gripper arm 53. The locking pin 64 in the slide can be made in one piece, In order for the first gripper arm 53 to no longer execute a pivoting movement when the locking pin is introduced to hole 61 of the gripper arm 53, the guide groove 63 is made without lateral offset on the end facing away from gripper arm 53.

In principle, it is conceivable to act on shaft 61 with a different type of mechanism, for example, via an electric motor, with a torque but a separate mechanism must then be provided to lock the first gripper arm 53. This would complicate the design and therefore make it more expensive.

For movement of the slide 62 a drive is therefore provided, which is designed as a pressure cylinder 65, for example, a compressed air cylinder. This pressure cylinder 65 is arranged within support piece 51 and has two pressure connections 66 which are arranged on both sides of piston 67 so that for movement of piston 67 it can be acted upon from one side with a force. The piston 67 is connected to slide 62 via piston rods 68. Pressure cylinder 65 is additionally equipped with two sensors (not shown) which send messages to a control device when the piston 67 has reached one of the two end positions. When this is the case, the first gripper arm is either completely opened or closed and locked. The latter of the two cases is shown in FIGS. 6 and 7.

Figure 8:
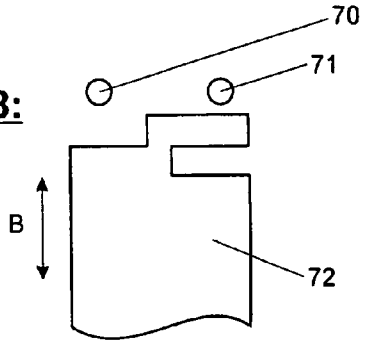

A sensor 70 is also shown in FIG. 7. A second sensor 71 arranged at the same height cannot be seen in this figure. These sensors touch a sheet 72 fastened to the contact element 57. The sensors detect whether the sheet lies in the scanning range of a sensor when the contact element 57 is moved in the direction of double arrow B. The sheet 72, as well as the arrangement of the sensors, is apparent from FIG. 8. The sheet is shaped so that it initially does not lie in the scanning range of the two sensors and so that one sensor is situated in the scanning range until ultimately the sheet lies in the scanning range of both sensors. Instead of the sheet, other elements can also be used that are moved with the contact element and have the same functionality together with the sensors. The two sensors can query a total of four positions of the contact element 57 together with the sheet: if both sensors detect no sheet, the gripper is empty, i.e., it has gripped no pin. If the sheet is in the scanning range of one of the sensors, the pin has been gripped. If the pin diameters are different for different rollers types, for example, for printing rollers and anilox rollers, a conclusion concerning the roller type can be made from the information as to which sensor "sees" the sheet. If the sheet lies in the scanning range of both sensors, a disturbance can be assumed, since now neither the gripper is empty nor has the roller of the two roller types been properly gripped. The information made available by the sensors can be fed to the control device, which uses these data to control the crane for changing rollers.

Figure 11:
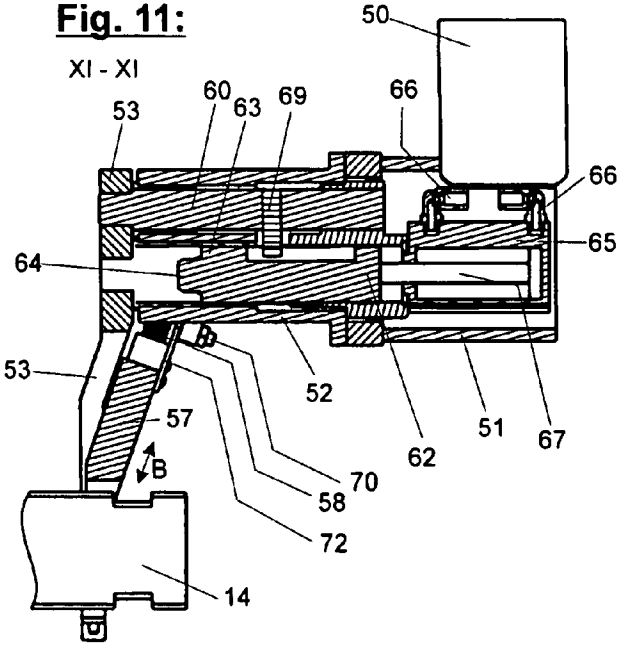
FIG. 11 The components from FIG. 6 and a sensor (with opened gripping arm)
Figure 10:
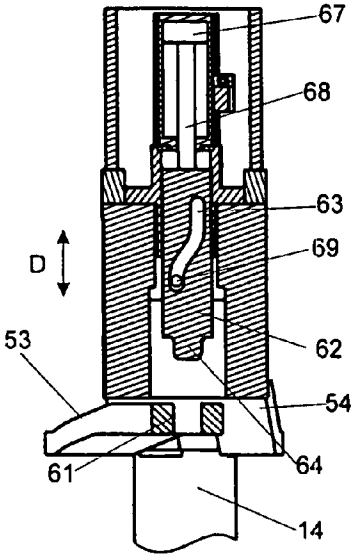
FIG. 10 The components of the mechanism with which the first gripping arm is pivoted (with opened gripping arm)
Figure 9:
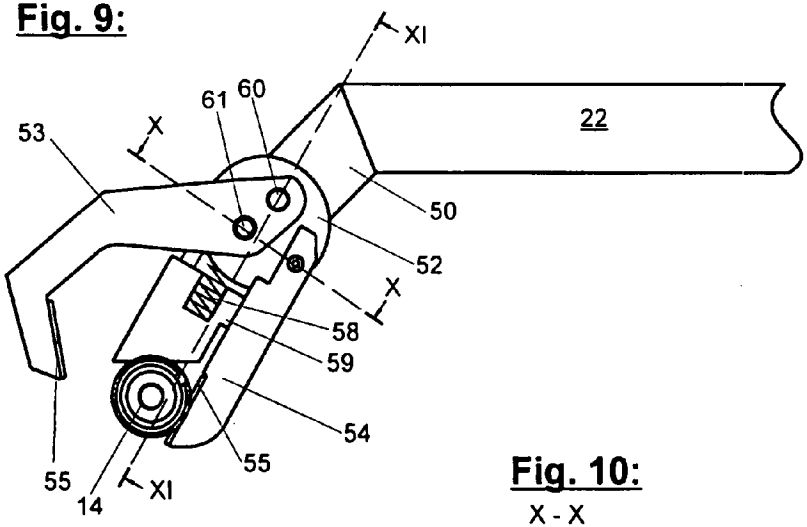
FIG. 9 View V-V from FIG. 2 with opened gripping arm

FIGS. 9, 10 and 11 show the same views as in FIGS. 5, 6 and 7 but with an opened first gripper arm 53. In order to reach this position the piston 67 was brought into its retracted position. Because of this the pin is forced leftward (see FIG. 10) so that the first gripper arm 53 was pivoted away.

For changing a roller 8, for example, for a job change, the procedure is as follows. A roller 8 lying in a printing machine is initially rotated by the rotation drive into a so-called null position in which the additional truncation 37 (in the case of a printing roller) or one of the additional truncations 37 (in the case of an anilox roller) points downward and runs horizontally, uncoupled from the rotation drive or the side register drive, in which shape-mated couplings are moved away from each other to the extent that the roller 8 lies completely free with its pin 14. The covers 18 of bearing 16 are now loosened. Actual tilting back of the cover 18 advantageously occurs by the pin during lifting of roller 8. The control device now determined the roll to be changed, for example, based on an operator input. The control device now controls crane 20. Initially the crane is positioned in height, then the boom 22 is deployed and now reaches above the inking system from which a roller is to be transported away. Actual positioning of the gripper on the pins now occurs. For this purpose through a combined lowering movement of the vertical adjustment and the horizontal movement of the boom the second gripper arm 54 is moved along its direction of extent. If three truncations 56 are present, this extent direction is sloped 30° from the vertical. The replaceable wear layer 56 of the second gripper arm 54 is then moved advantageously a few millimeters past one of the truncations 56. Contact of these two elements is still not necessary and also not desired because of wear related to it. The movement path is chosen large enough so that when the first gripper arm 53 is closed, it also does not touch the corresponding truncation or only does so without exerting noticeable force. This is advantageous, since only a comparatively small torque need be applied for the pivot movement of the first gripper arm 53. For this purpose a compressed air piston is sufficient, which moves the slide and with it the first gripper arm 53 in the described manner.

When the mentioned position of second gripper arm 54 is reached, which is recognized by the fact that the sensor 70 or 71 (depending on the roller type) issues a signal, the pressure cylinder 65 can now be set, i.e., the piston 67 is moved by introducing a pressure medium in the direction toward the gripper arm. The mechanism just described now ensures that the first gripper arm 53 closes. Only when the gripper arm 53 is reached its closure position and has been properly locked by the locking pin 64 can the piston 67 reach its second end position, which is detectable by the corresponding sensor (see above). If the sensor issues no corresponding signal, a disturbance could be present. This can be made apparent to the operating personnel via a display device, for example, a monitor or an appropriate warning device. If the first gripper arm 53, however, is locked, the roller 8 is lifted out from the inking system (advantageously first in the vertical direction). The replaceable wear layers 55 initially lie against the truncations. The roller 8 is transferred into a roller position 31 or 32 of bearing 30. Since the roller 8 still assumes a defined angle position in the gripper, the roller can now be positioned so that the additional truncations 37 are in contact with corresponding mating elements so that the roller also cannot rotate in the roller bearing and lies in the correct angle position for further acceptance by the gripper. This mating element can be a sheet arranged edge-on so that the additional truncation 37 touches the upper edge of the sheet.

Loosening of the gripper occurs by opening of the first gripper arm 53, in which after successful opening the second sensor of the pressure cylinder 65 sends a corresponding signal to the control device. The gripper 21 must now be moved again in the direction of extent of the second gripper arm 54.

Insertion of a new roll occurs in the reverse sequence.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numerals | |
|---|---|
| 1 | Printing machine |
| 2 | Impression cylinder |
| 3 | Stock |
| 4 | Pressure roller |
| 5 | Inking system |
| 6 | Bracket |
| 7 | Central machine frame |
| 8 | Printing roller |
| 9 | Anilox roller |
| 10 | Doctor blade chamber |
| 11 | Imaginary center line |
| 12 | Guide rail |
| 13 | Bearing block |
| 14 | Pin |
| 15 | Spindle nut |
| 16 | Bearing |
| 17 | Shell |
| 18 | Cover |
| 19 | Coupling |
| 20 | Crane |
| 21 | Gripper |
| 22 | Boom |
| 23 | Support beam |
| 24 | Vertical support |
| 25 | Column |
| 26 | Support |
| 27 | Support frame |
| 28 | Free space |
| 29 | Roller transport cart |
| 30 | Roller bearing |
| 31 | Roller position |
| 32 | Change position |
| 33 | Column |
| 34 | Beveling |
| 35 | Recess |
| 36 | Support |
| 37 | Additional truncation |
| 38 | |
| 39 | |
| 40 | Attachment |
| 41 | Drive |
| 42 | Movement device |
| 43 | |
| 44 | |
| 45 | |
| 46 | |
| 47 | |
| 48 | |
| 49 | |
| 50 | Angle piece |
| 51 | Support piece/tube-like piece |
| 52 | Bearing and guide piece |
| 53 | First gripper arm |
| 54 | Second gripper arm |
| 55 | Replaceable wear layer |
| 56 | Truncation |
| 57 | Contact element |
| 58 | Spring element |
| 59 | Attachment |
| 60 | Shaft |
| 61 | Hole |
| 62 | Slide |
| 63 | Guide groove |
| 64 | Locking pin |
| 65 | Pressure cylinder |
| 66 | Pressure connection |
| 67 | Piston |
| 68 | Piston rod |
| 69 | Pin |
| 70 | Sensor |
| 71 | Sensor |

-continued

| List of reference numerals | |
|---|---|
| 72 | Sheet |
| 73 | |
| B | Movement direction of contact element 57 |
| D | Movement direction of slide 62 |

What is claimed is:

1. A device for gripping and transporting at least one ink-attracting cylinder of a printing machine, comprising:

support elements that enter into contact with pins of the cylinder in order to be able to grip the cylinder;

each support element including at least a first and a second gripper arm, with which a pin of thecylinder can at least be partially gripped, the first gripper arm being movable between an open position and a closed position in which the pin is gripped, and the second gripper arm being fixed, with the first and second gripper arms being configured to grip the cylinder from above; and a locking device that secures the first and second gripper arms in the closed position, the locking device including a locking pin arranged on an end of a slide, with the locking pin engaging in the closed position a hole located inthe first gripper arm.

2. The device according to claim 1, wherein the first gripper arm is arranged on an and of a shaft, the shaft carrying a radially extending pin.

3. The device according to claim 1, wherein the first gripper arm is movable by action of the slide, which is driven by a pressure cylinder.

4. The device according to claim 3, wherein a guide groove pin engages in a guide groove introduced to the slide.

5. The device according to claim 3, wherein the slide is movable in an axial direction of the shaft.

6. The device according to claim 1, wherein the first and second gripper arms include support edges on which the pin of the cylinder lies when the cylinder is supported, the support edges enclosing an angle of less than 180°.

7. The device according to claim 6, wherein the support edges enclose an angle of 120°.

8. The device according to claim 6, wherein the support edges enclose an angle of 60°.

9. The device according to claim 1, wherein the support element includes a contact element which is in contact with the pin of the cylinder when the first and second gripper arms grip the pin.

10. The device according to claim 9, wherein the contact element is configured to be pressed against the pin with a spring element.

11. The device according to claim 9, wherein the contact element is movable relative to the support element along guides.

12. The device according to claim 9, wherein the support element includes sensors with which positions of the contact element can be determined.

13. The device according to claim 9, wherein outer surfaces of the pin on which the contact element lies have different spacings corresponding to an axis of rotation of the cylinder and different cylinder types.

14. The device according to claim 1, wherein the first gripper arm is movable relative to the fixed second gripper arm.

15. The device according to claim 1, wherein the first gripper arm is rotatable.

16. The device according to claim 1, wherein the device is configured to at least one of raise and lower the cylinder.

17. A method of gripping and transporting an ink-attracting cylinder of a printing machine with a device that includes support elements that enter into contact with pins of the cylinder in order to be able to grip the cylinder, each support element including at least a first and a second gripper arm, with which a pin of the cylinder can at least be partially gripped, the first gripper arm being movable between an open position and a closed position in which the pin is gripped and the second gripper arm being fixed, and a locking device having a locking pin arranged on an end of a slide, with the locking pin engaging in the closed position a hole located in the first gripper arm, said method comprising:

the support elements entering into contact with the pins of the cylinder and gripping the cylinder from above; and the locking device securing the first and second gripper arms in the closed position for transport of the cylinder.

18. The method according to claim 17, wherein the gripping of the cylinder is effected by the first and second gripper arms.

19. A device for gripping and transporting an ink-attracting cylinder of a printing machine, comprising:

support elements that enter into contact with pins of the cylinder in order to grip the cylinder, each support element including at least a first and a second gripper arm, with which a pin of the cylinder can at least be partially gripped, the first gripper arm being movable between an open position and a closed position in which the pin is gripped, with the first and second gripper arms being configured to grip the cylinder from above, and the support element including a contact element which is in contact with the pin of the cylinder when the first and second gripper arms grip the pine.

20. The device according to claim 19, wherein the first gripper arm is rotatable relative to the second gripper arm.

21. The device according to claim 19, further comprising a locking device that secures the first and second gripper arms in a closed position, the locking device including a locking pin arranged on an end of a slide, the locking pin engaging in the closed position a hole located in the first gripper arm.

* * * * *